US007917058B2

(12) United States Patent
Maehata et al.

(10) Patent No.: US 7,917,058 B2
(45) Date of Patent: Mar. 29, 2011

(54) IMAGE FORMING APPARATUS WITH CARTRIDGE LOADING DEVICE

(75) Inventors: Yasuhiro Maehata, Sagamihara (JP); Makoto Kikura, Yokohama (JP); Tetsuji Nishikawa, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 427 days.

(21) Appl. No.: 12/081,628

(22) Filed: Apr. 18, 2008

(65) Prior Publication Data

US 2008/0260420 A1 Oct. 23, 2008

(30) Foreign Application Priority Data

Apr. 20, 2007 (JP) ..... 2007-111151

(51) Int. Cl.
*G03G 15/00* (2006.01)

(52) U.S. Cl. ..... 399/111; 399/110; 399/124; 399/125

(58) Field of Classification Search ..... 399/110, 399/111, 124, 125
See application file for complete search history.

(56) References Cited

U.S. PATENT DOCUMENTS

| | | | | |
|---|---|---|---|---|
| 7,272,341 | B2 * | 9/2007 | Jung et al. | 399/111 |
| 2007/0166073 | A1 * | 7/2007 | Idehara et al. | 399/110 |

FOREIGN PATENT DOCUMENTS

| | | | |
|---|---|---|---|
| JP | 7-120136 | | 12/1995 |
| JP | 09-292816 | | 11/1997 |
| JP | 20000181329 | A * | 6/2000 |
| JP | 3420681 | | 4/2003 |
| JP | 3484326 | | 10/2003 |
| JP | 2004-117988 | | 4/2004 |
| JP | 2006-113170 | | 4/2006 |

OTHER PUBLICATIONS

English Language Abstract of JP 10-282863 dated Oct. 23, 1998.
English Language Abstract of JP 11-084868 dated Mar. 30, 1999.
English Language Abstract of JP 02-140760 dated May 30, 1990.

* cited by examiner

*Primary Examiner* — David M Gray
*Assistant Examiner* — G. M. Ali Hyder
(74) *Attorney, Agent, or Firm* — Harness, Dickey & Pierce, P.L.C.

(57) ABSTRACT

An image forming apparatus that includes at least one process cartridge having a photosensitive element, a development unit, a toner storage unit, a driven shaft and a driven gear mounted thereon and which is detachably attachable to the apparatus from a top front side thereof, a drive shaft, a drive gear mounted on the drive shaft to couple with and drive the driven gear to transmit a driving force to the process cartridge, an upper cover opening and closing with respect to the apparatus, a front cover opening and closing with respect to the apparatus, and at least one block component to block coupling of the drive gear and the driven gear by contacting the driven shaft while interlocked with opening and closing of the upper cover. The process cartridge is detachably attachable to the apparatus from the front top side thereof by opening and closing the upper cover.

11 Claims, 10 Drawing Sheets

IMAGE FORMING APPARATUS WITH CARTRIDGE LOADING DEVICE

CROSS-REFERENCE TO RELATED APPLICATION

This patent specification is based on and claims priority from Japanese Patent Application No. 2007-111151, filed on Apr. 20, 2007 in the Japan Patent Office, the entire contents of which are hereby incorporated by reference herein.

BACKGROUND

1. Field of the Invention

The present invention relates to an image forming apparatus.

2. Description of the Related Art

There is a demand for a compact image forming apparatus with a small footprint. In addition, since an image forming apparatus such as a printer, by its nature, may be located with little space on both sides thereof, it is desirable that consumables such as a process cartridge be replaced by a user from the front of the apparatus, which is referred to as front operation.

In one example image forming apparatus provided with a drive coupling to transmit a driving force from the image forming apparatus to the process cartridge, the front operation of replacing the process cartridge is enabled by retracting the drive coupling during replacement of the process cartridge. The drive coupling is connected to a driven coupling of the process cartridge when an upper cover of the image forming apparatus is closed.

However, this method requires a space to retract the drive coupling, which increases the apparatus size in the width direction of the image forming apparatus. Specifically, such an image forming apparatus is designed to prevent damage caused by interference between the drive coupling and the process cartridge. The drive coupling, which transmits the driving force to the process cartridge, needs to be retracted during installation of the process cartridge, which causes an increase in the apparatus size in the width direction.

This problem may be solved by transmitting the driving force through a gear linkage. However, in this case, a driven gear of the process cartridge directly meshes with a drive gear of the image forming apparatus when the process cartridge is installed in the image forming apparatus. Therefore, a user needs to push the process cartridge hard into the image forming apparatus, which tends to damage the gears.

SUMMARY

This patent specification describes a novel image forming apparatus that includes at least one process cartridge having a photosensitive element, a development unit, a toner storage unit, a driven shaft and a driven gear mounted thereon and which is detachably attachable to the image forming apparatus from a top front side thereof, a drive shaft, a drive gear mounted on the drive shaft to couple with and drive the driven gear to transmit a driving force to the process cartridge, an upper cover opening and closing with respect to the image forming apparatus, a front cover opening and closing with respect to the image forming apparatus, and at least one block component to block coupling of the drive gear and the driven gear by contacting the driven shaft while interlocked with opening and closing of the upper cover. The process cartridge is detachably attachable to the image forming apparatus from the front top side thereof by opening and closing the upper cover.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
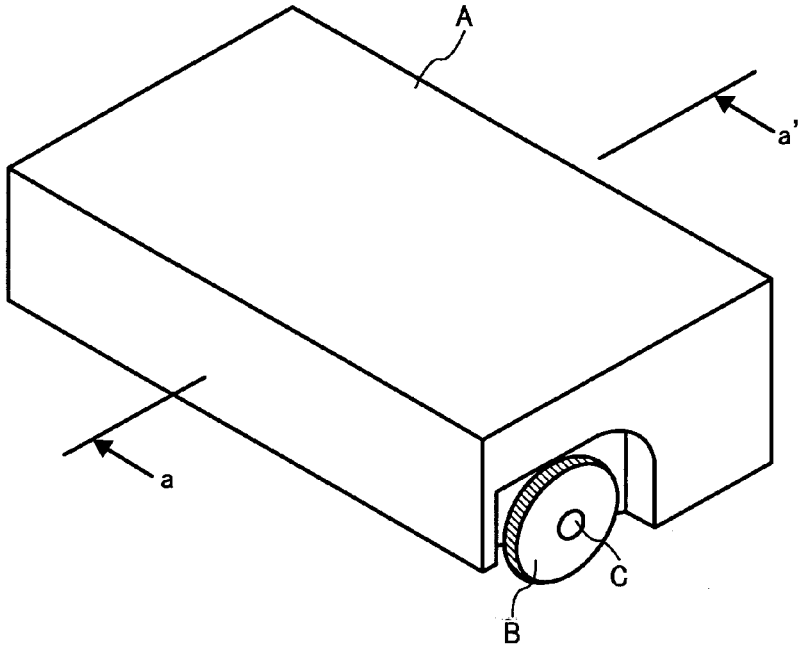
FIG. 1 is a perspective view illustrating an example process cartridge used in the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 4:
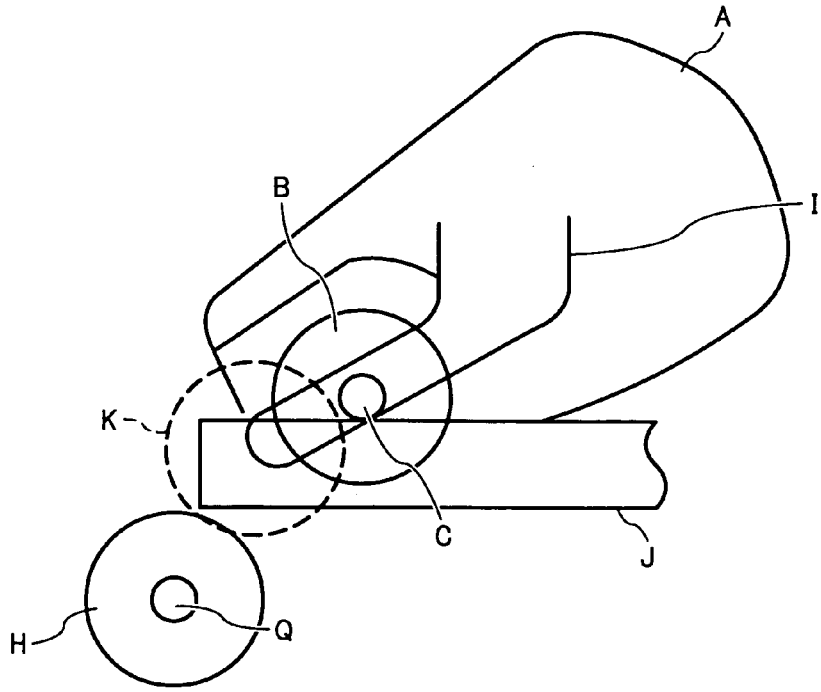
FIG. 4 is a diagram illustrating insertion of the process cartridge into the image forming apparatus according to a first embodiment of the present invention.

Referring now to the drawings, wherein like reference numerals and reference characters designate identical or corresponding parts throughout the several views thereof, particularly to FIG. 4, image forming apparatuses according to exemplary embodiments of the present invention are described.

Figure 2:
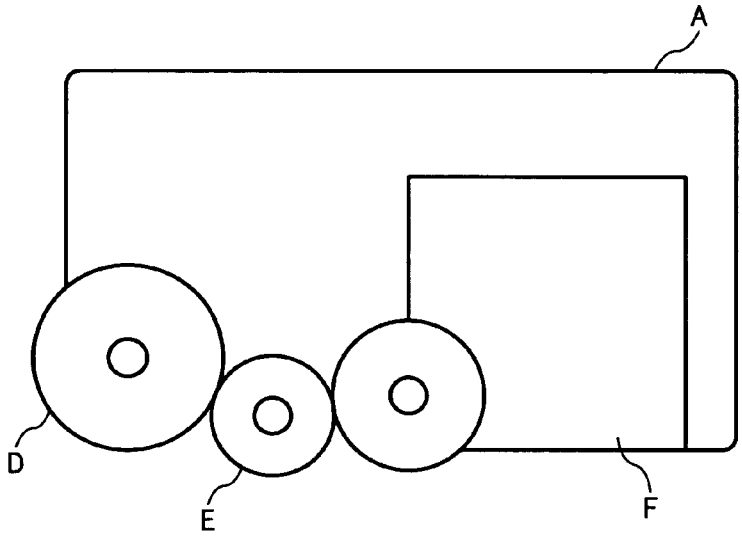
FIG. 2 is a cross-sectional diagram illustrating the process cartridge along line a-a' of FIG. 1.

FIG. 1 is a perspective view illustrating an example process cartridge used in the present invention. FIG. 2 is a cross-sectional diagram illustrating the process cartridge along line a-a' of FIG. 1. The process cartridge A serves as an image forming unit and includes a photosensitive element D, a development unit E, and a toner storage unit F. The process cartridge A also includes a driven shaft C and a driven gear B mounted on the driven shaft C to receive a driving force from a drive gear H provided to an image forming apparatus G.

Figure 3:
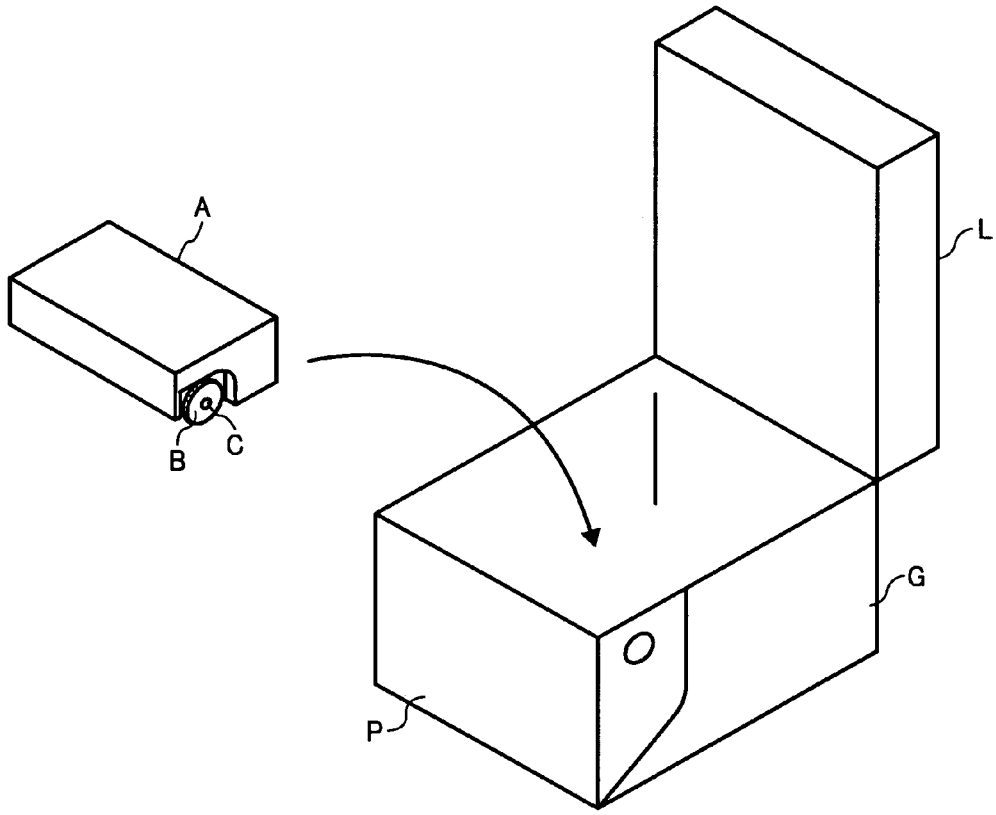
FIG. 3 is a perspective view illustrating an example image forming apparatus in which the process cartridge of FIGS. 1 and 2 is to be installed.

FIG. 3 is a perspective view illustrating an example image forming apparatus in which the process cartridge A of FIGS. 1 and 2 is to be installed. The image forming apparatus G includes an upper cover L and a front cover P and is configured such that the upper cover L can be opened with respect to the image forming apparatus G and the process cartridge A is detachably installed therein from above the image forming apparatus G, thereby enabling insertion and removal of the process cartridge A by a user from the front of the image forming apparatus G. The front cover P is also opened and closed with respect to the image forming apparatus G.

Figure 5:
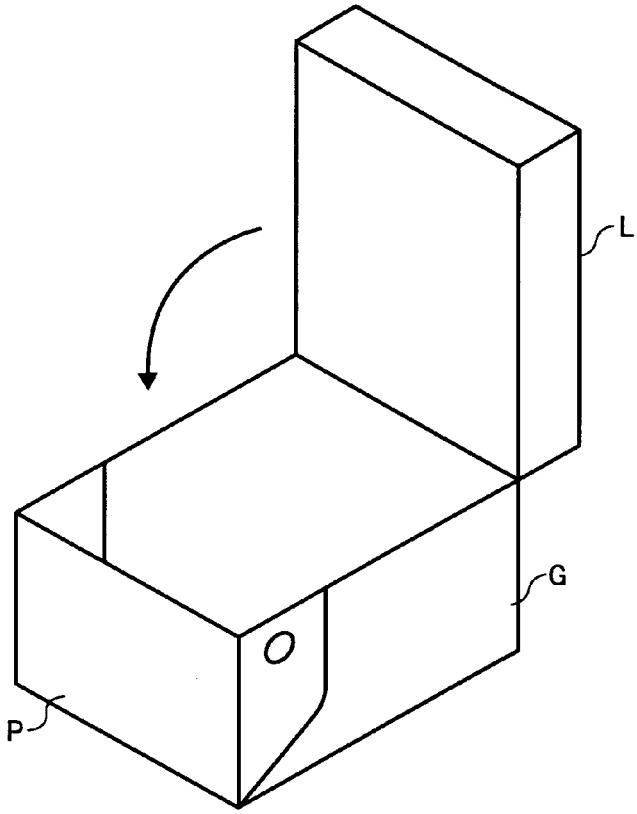
FIG. 5 is a perspective view illustrating the image forming apparatus with an upper cover opened.

FIGS. 4 through 7 illustrate a first embodiment of the present invention. FIG. 4 is a diagram illustrating insertion of the process cartridge A into the image forming apparatus G. Typically, the process cartridge A is inserted into the image forming apparatus G by guiding the driven shaft C to a position (referred to as a positioning position K) by a positioning guide rail I provided to the image forming apparatus G so that the driven gear B meshes with the drive gear H at the positioning position K. In the first embodiment, a block component J is located at an intermediate point on the path of the driven shaft C moving along the positioning guide rail I to the positioning position K so that the driven gear B is prevented from meshing with the drive gear H during installation of the process cartridge A in the image forming apparatus G (i.e., when the upper cover L is opened as illustrated in FIG. 5).

Figure 6:
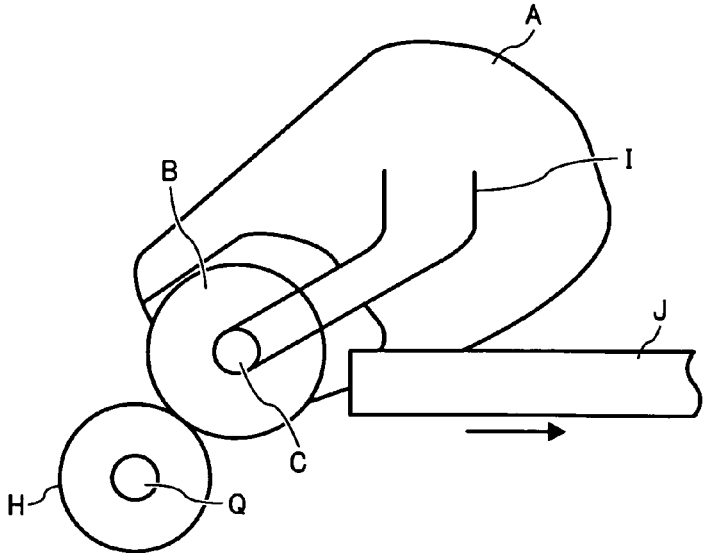
FIG. 6 is a diagram illustrating retraction of a block component according to movement of the upper cover.
Figure 7:
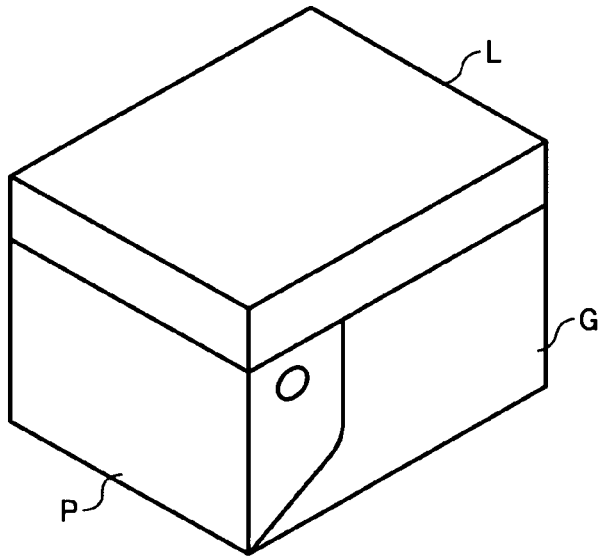
FIG. 7 is a perspective view illustrating the image forming apparatus with the upper cover closed.

After the process cartridge A is installed in the image forming apparatus G, the upper cover L is closed as illustrated in FIG. 7. According to the closing movement of the upper cover L, the block component J is retracted from the path of the driven shaft C as illustrated in FIG. 6 so that the driven shaft C moves to the position (the positioning position K illustrated in FIG. 4) and the driven gear B meshes with the drive gear H.

Specifically, the first embodiment enables installation of the process cartridge A in the image forming apparatus G by a user from the front of the image forming apparatus G and prevention of damage to the drive gear H during installation of the process cartridge A without increasing the size in the width direction of the image forming apparatus using the process cartridge. In other words, during replacement of the process cartridge A, the block component J blocks the driven shaft C of the process cartridge A at the intermediate point on the path of the driven shaft C moving to the positioning position K so that the driven gear B is prevented from meshing with the drive gear H. By closing the upper cover L, the block component J is retracted from the path of the driven shaft C, the driven shaft C moves to the positioning position K by the weight of the process cartridge A, and the driven gear B meshes with the drive gear H. Consequently, when the user pushes the process cartridge A hard into the image forming apparatus G, the driven gear B and the drive gear H are prevented from contacting each other and thereby being broken.

Figure 8:
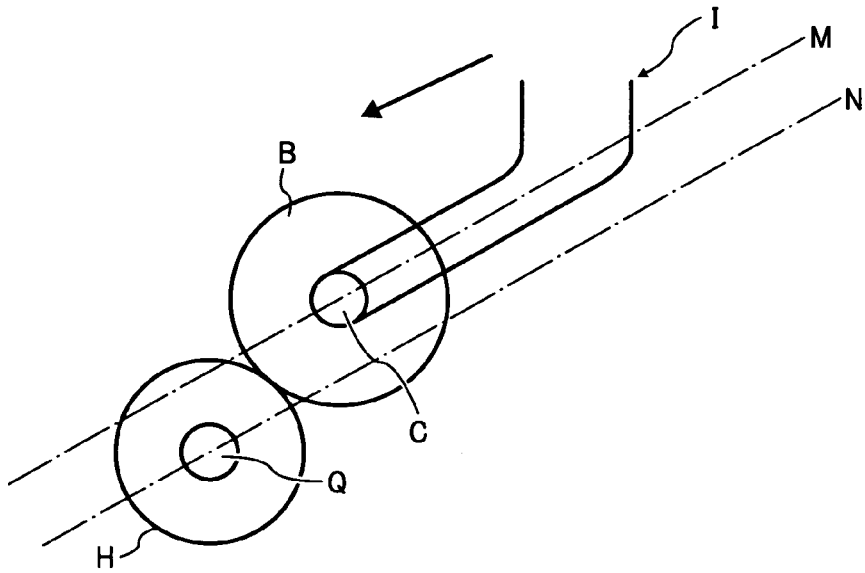
FIG. 8 is a diagram illustrating a second embodiment of the present invention.

FIG. 8 is a diagram illustrating a second embodiment of the present invention. In the second embodiment, the driven shaft C moving to the positioning position K and a drive shaft Q of the drive gear H are located at different positions indicated by M and N in FIG. 8, respectively, relative to the direction of movement of the driven shaft C. When the driven gear B meshes with the drive gear H, a line connecting the driven shaft C and the drive shaft Q is out of alignment with the direction of movement of the driven shaft C, and therefore the top parts of the driven gear B and the drive gear H are prevented from crashing head-on into each other and the driven gear B and the drive gear H are thereby prevented from failing to mesh with each other. Consequently, a failure of transmission of the driving force to the process cartridge A due to gear disengagement is prevented.

Figure 9:
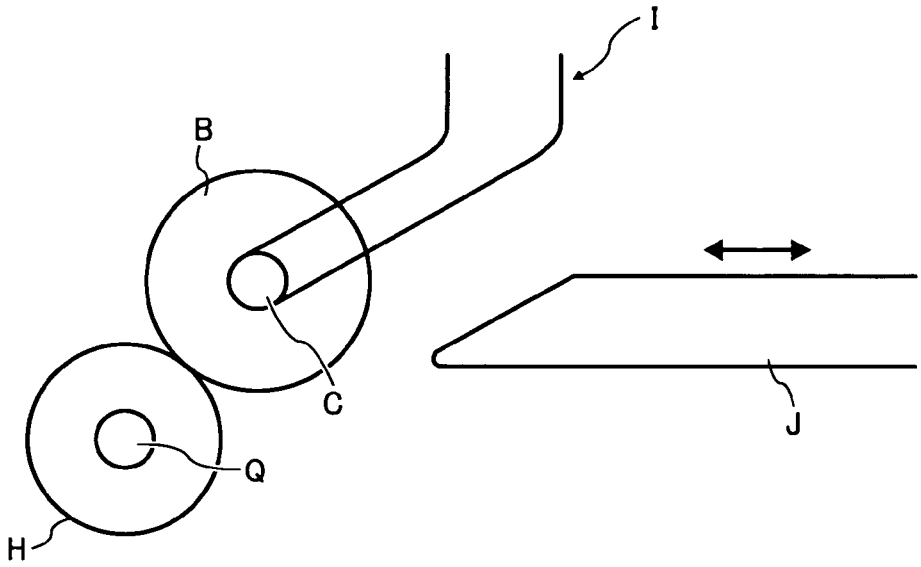
FIG. 9 is a diagram illustrating a third embodiment of the present invention.

FIG. 9 is a diagram illustrating a third embodiment of the present invention. In the third embodiment, the block component J has a tapered end. This block component J easily catches the driven shaft C when the upper cover L is opened. Consequently, the block component J functions smoothly by opening and closing the upper cover L.

Figure 10:
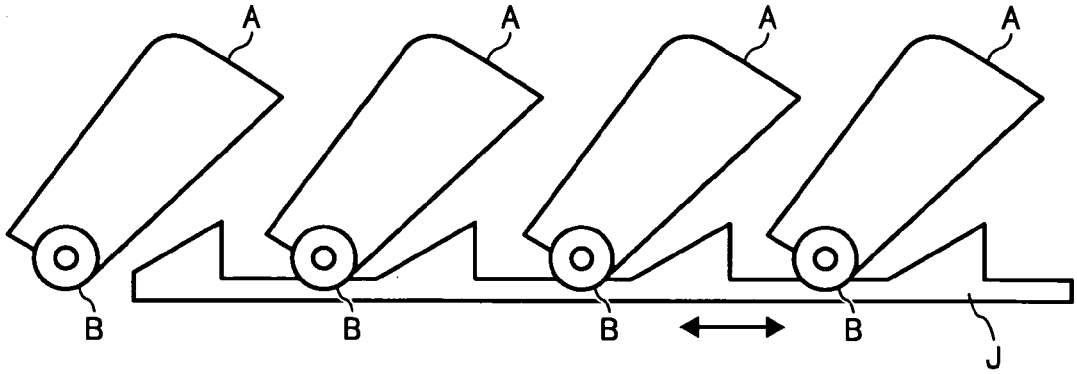
FIG. 10 is a diagram illustrating a fourth embodiment of the present invention.

FIG. 10 is a diagram illustrating a fourth embodiment of the present invention. In the fourth embodiment, the image forming apparatus G is configured as a color image forming apparatus using four process cartridges A (containing toners of different colors, for example, yellow, magenta, cyan, and black). The block components J each with a tapered portion are provided to the four process cartridges A and simultaneously move according to the movement of the upper cover L of the image forming apparatus G. By forming the block components J for four colors as an integrated unit that moves according to the movement of the upper cover L, the color image forming apparatus is configured with fewer components.

Figure 11:
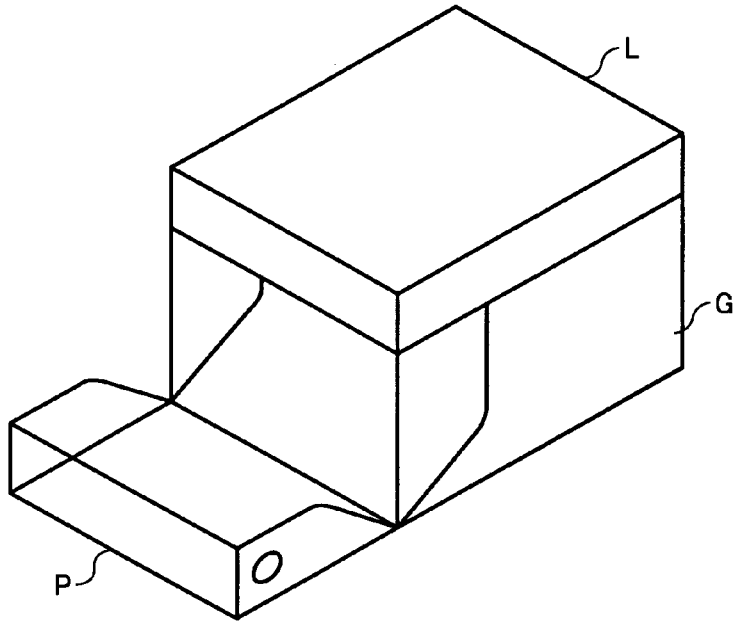
FIG. 11 is a perspective view illustrating a fifth embodiment of the present invention with a front cover opened.
Figure 12:
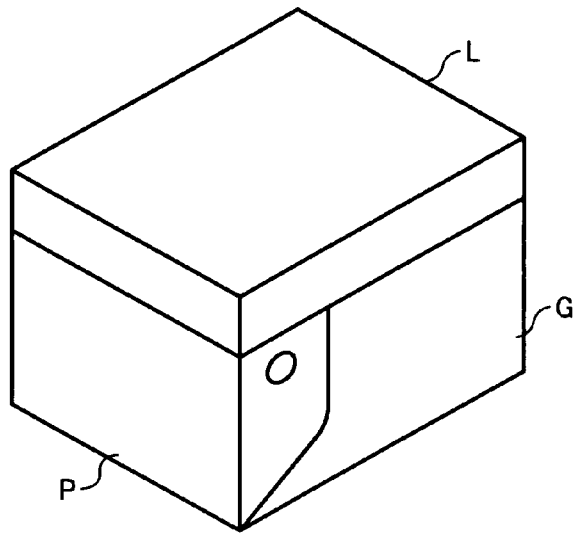
FIG. 12 is a perspective illustrating the fifth embodiment of the present invention with the front cover closed.

FIGS. 11 and 12 are diagrams illustrating a fifth embodiment of the present invention. In the fifth embodiment, the block component J also moves according to the movement of the front cover P of the image forming apparatus G using the same mechanism as that in the above-described embodiments. When the front cover P is opened as illustrated in FIG. 11, the block component J is located at the position illustrated in FIG. 4. When the front cover P is closed as illustrated in FIG. 12, the block component J is located at the position illustrated in FIG. 6. Further, the movement of the block component J according to the opening movement of the front cover P separates the photosensitive element D included in the process cartridge A from a transfer unit included in the image forming apparatus G. Consequently, when the image forming apparatus G employs a direct transfer system, a sheet of paper stuck between the photosensitive element D and the transfer unit can be easily removed.

Figure 13:
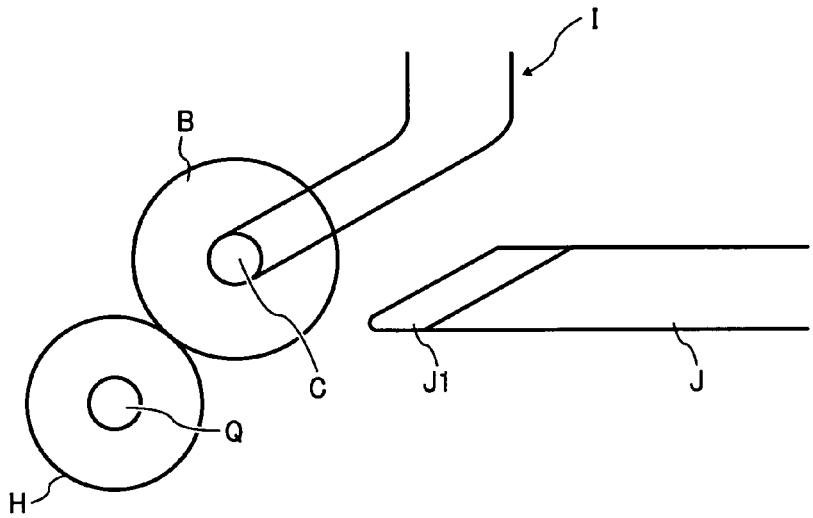
FIG. 13 is a diagram illustrating a sixth embodiment of the present invention.

FIG. 13 is a diagram illustrating a sixth embodiment of the present invention. In the sixth embodiment, the block component J having a tapered end includes a shock-absorbing member J1 located where the block component J contacts the driven shaft C. In the configuration according to the first embodiment, the block component J blocks the driven shaft C of the process cartridge A from moving to the positioning position K in the image forming apparatus G so that the driven gear B does not mesh with the drive gear H during replacement of the process cartridge A. However, in this case, the driven shaft C directly contacts the block component J. In the sixth embodiment, the shock-absorbing member J1 is provided to reduce the shock at the contact point. Consequently, deformation of the driven shaft C due to contact with the block component J is prevented. In addition, the shock-absorbing member J1 has high surface friction so that the driven shaft C rotates when the block component J is retracted according to the movement of the upper cover L. Consequently, the driven gear B easily meshes with the drive gear H upon retraction of the block component J.

Figure 14:
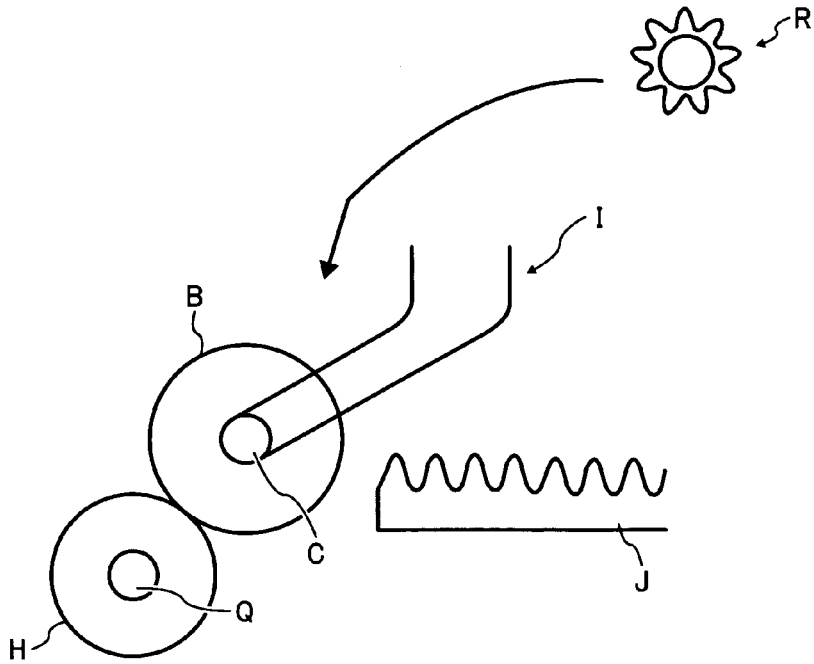
FIG. 14 is a diagram illustrating a seventh embodiment of the present invention.

FIG. 14 is a diagram illustrating a seventh embodiment of the present invention. In the seventh embodiment, a pinion R is attached to the end of the driven shaft C and the block component J includes a rack. As the block component J moves, the driven shaft C rotates. By providing the driven shaft C with the pinion R at the contact point between the driven shaft C and the block component J and providing the block component J with the rack, the driven shaft C rotates when the block component J is retracted according to the movement of the upper cover L. Consequently, the driven gear B easily meshes with the drive gear H upon retraction of the block component J.

Figure 15:
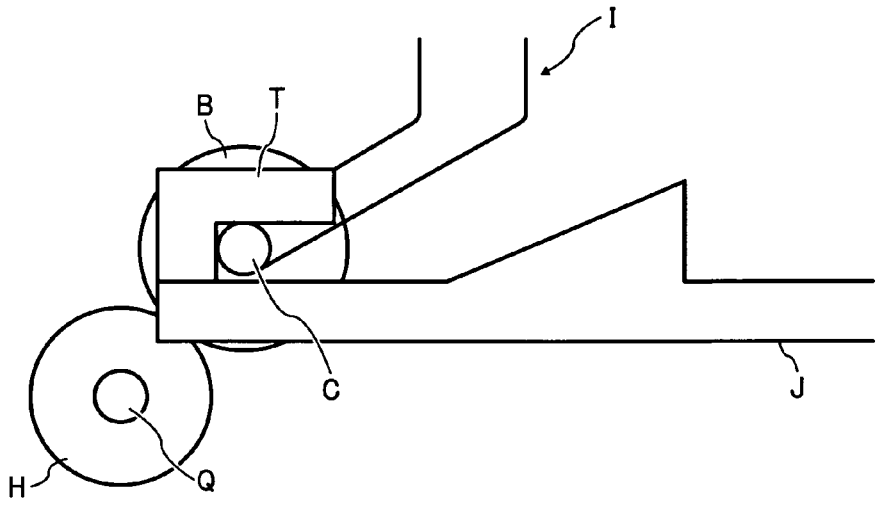
FIG. 15 is a diagram illustrating an eighth embodiment of the present invention.

FIG. 15 is a diagram illustrating an eighth embodiment of the present invention. In the eighth embodiment, the block component J with a triangular tapered portion is provided with a biasing member T, U-shaped in cross section, that biases the driven shaft C from above when the block component J is retracted and the driven shaft C moves to the positioning position K. In addition, by using, for example, a one-way clutch, the driven shaft C of the process cartridge A is provided with a one-way function such that the driven gear B rotates during closing movement of the upper cover L (i.e., during retracting of the block component J) and a torque is not applied to the driven gear B during opening movement of the upper cover L (i.e., during separation of the driven gear B from the drive gear H by the block component J). Therefore, the driven gear B does not rotate during opening movement of the upper cover L even when the driven gear B meshes with the drive gear H. By providing the block component J with the biasing member T that biases the driven shaft C from above when the block component J is retracted and the driven shaft C moves to the positioning position K, the driven shaft C is biased from above to the positioning position K. Consequently, the process cartridge A is securely positioned and therefore a good image can be produced.

Figure 16:
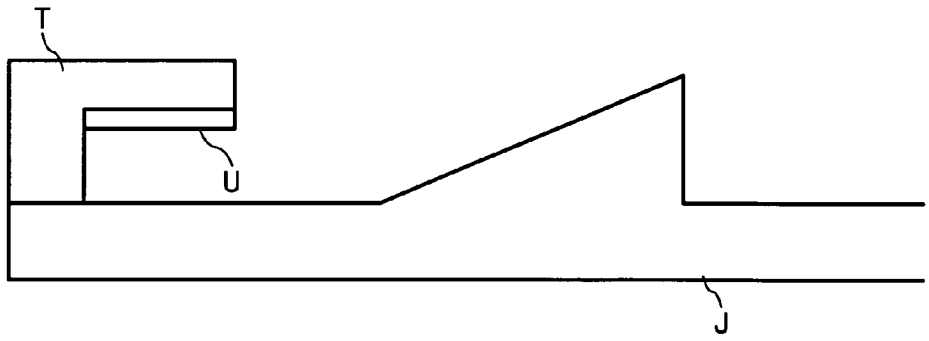
FIG. 16 is a diagram illustrating a ninth embodiment of the present invention.

FIG. 16 is a diagram illustrating a ninth embodiment of the present invention. In the ninth embodiment, the block component J is provided with a shock-absorbing member U at the contact point between the driven shaft C and the biasing member T that biases the driven shaft C from above when the block component J is retracted and the driven shaft C moves to the positioning position K. The shock-absorbing member U absorbs vibration of the driven shaft C occurring during transmission of the driving force to the process cartridge A. Consequently, the process cartridge A is securely positioned, and reduction in vibration caused by the gear mesh results in production of a good image with little color irregularity.

Figure 17:
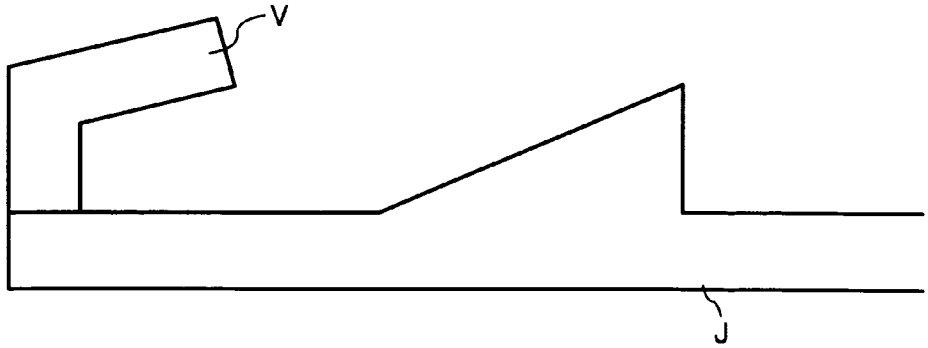
FIG. 17 is a diagram illustrating a tenth embodiment of the present invention.

FIG. 17 is a diagram illustrating a tenth embodiment of the present invention. In the tenth embodiment, the block component J is provided with an angled biasing member V that biases the driven shaft C from above when the block component J is retracted and the driven shaft C moves to the positioning position K. Consequently, the driven shaft C with component tolerances is easily guided and the process cartridge A is securely positioned and therefore a good image can be produced.

Figure 18:
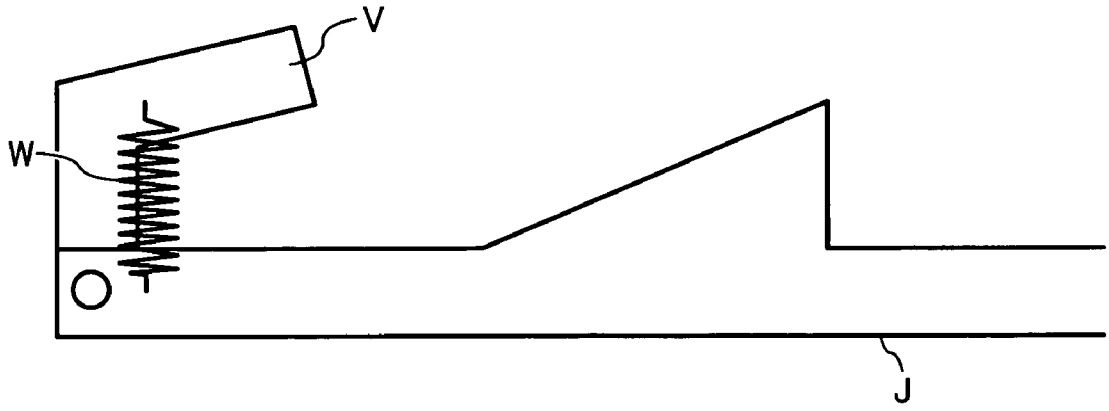
FIG. 18 is a diagram illustrating an eleventh embodiment of the present invention.
Figure 19:
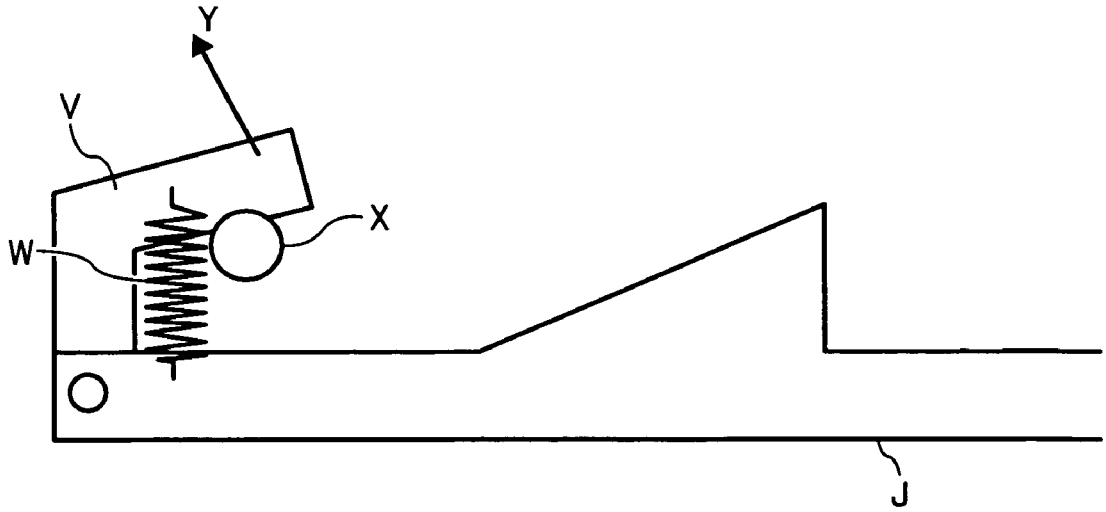
FIG. 19 is a diagram illustrating the eleventh embodiment of the present invention.
Figure 20:
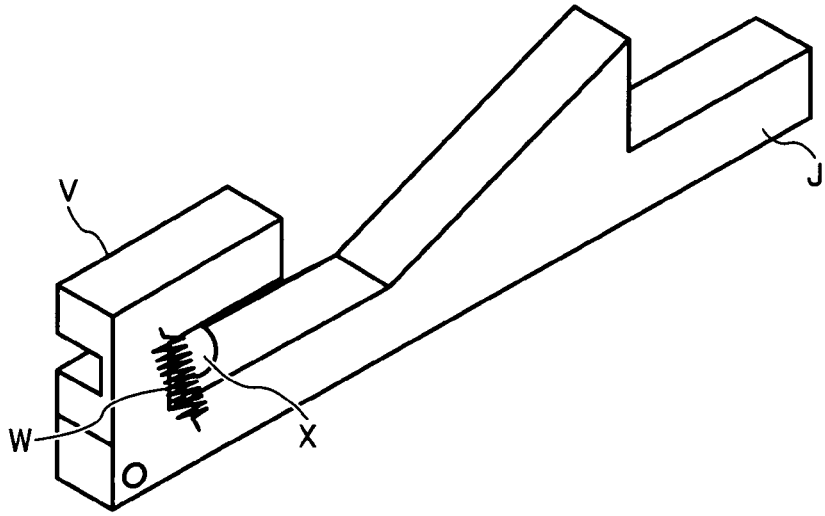
FIG. 20 is a perspective view illustrating the eleventh embodiment of the present invention.

FIGS. 18 through 20 are diagrams illustrating an eleventh embodiment of the present invention. In the eleventh embodiment, the biasing member V that biases the driven shaft C from above when the block component J is retracted and the driven shaft C moves to the positioning position K is formed as a separate unit and attached to the block component J with an elastic body W. With the elastic body W, the biasing portion of the biasing member V is biased in the direction opposite to the direction indicated by arrow Y in FIG. 19 so that the driven shaft C is securely biased by the biasing member V from above. Consequently, the process cartridge A is securely positioned and therefore a good image can be produced. In addition, a pin X may be provided to the image forming apparatus G. When the upper cover L of the image forming apparatus G is opened (i.e., when the block component J moves in the direction to separate the driven gear B from the drive gear H), the pin X moves the biasing portion of the biasing member V in the direction indicated by arrow Y in FIG. 19 so that the driven shaft C is not biased.

Figure 21:
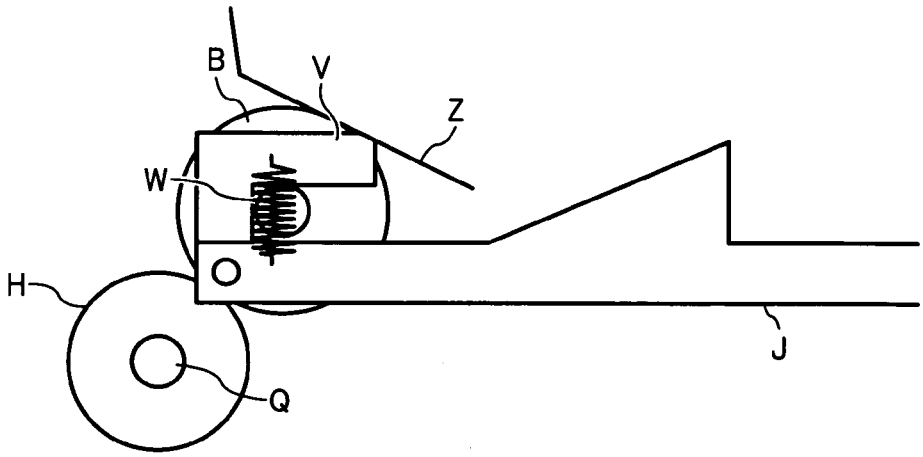
FIG. 21 is a diagram illustrating a twelfth embodiment of the present invention.

FIG. 21 is a diagram illustrating a twelfth embodiment of the present invention. In the twelfth embodiment, the biasing member V that biases the driven shaft C from above when the block component J is retracted and the driven shaft C moves to the positioning position K is formed as a separate unit and a frame (guide rail) Z, which is a rigid body, is provided to the image forming apparatus G. When the biasing member V biases the driven shaft C from above, the frame Z biases the biasing member V from the side opposite to where the elastic body W is attached to the block component J so that the driven shaft C is securely biased from above. Consequently, the process cartridge A is securely positioned and therefore a good image can be produced.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer-program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

at least one process cartridge including a photosensitive element, a development unit, a toner storage unit, a driven shaft and a driven gear mounted thereon and which is detachably attachable to the image forming apparatus from a top front side thereof;

a drive shaft;

a drive gear mounted on the drive shaft and configured to couple with and drive the driven gear to transmit a driving force to the process cartridge;

an upper cover structured to open and close with respect to the image forming apparatus;

a front cover structured to open and close with respect to the image forming apparatus; and at least one block component configured to block coupling of the drive gear and the driven gear by contacting the driven shaft while interlocked with opening and closing of the upper cover, wherein the process cartridge is detachably attachable to the image forming apparatus from the front top side thereof by opening and closing the upper cover, and the drive gear and the driven gear are coupled such that a line connecting the drive shaft and the driven shaft is out of alignment with a moving direction of the driven shaft when attaching or detaching the process cartridge.

2. The image forming apparatus according to claim 1, wherein a portion of the block component which blocks coupling of the drive gear and the driven gear is tapered.

3. The image forming apparatus according to claim 1, wherein the block component is configured to block coupling of the drive gear and the driven gear by contacting the driven shaft while interlocked with opening and closing of the front cover.

4. The image forming apparatus according to claim 1, wherein a pinion is provided to the driven shaft and a rack is provided to the block component.

5. The image forming apparatus according to claim 1, wherein the driven shaft of the process cartridge comprises a one-way function.

6. The image forming apparatus according to claim 1, wherein the block component comprises a biasing member, the biasing member being configured to bias the driven shaft from above when the drive gear meshes with the driven gear.

7. The image forming apparatus according to claim 6, wherein the biasing member comprises an angled portion.

8. The image forming apparatus according to claim 7, wherein the biasing member is formed as a separate unit and attached to the block component by an elastic body.

9. The image forming apparatus according to claim 8, further comprising a frame configured to bias the biasing member from a side opposite to where the elastic body is attached.

10. An image forming apparatus comprising:

at least one process cartridge including a photosensitive element, a development unit, a toner storage unit, a driven shaft and a driven gear mounted thereon and which is detachably attachable to the image forming apparatus from a top front side thereof;

a drive shaft;

a drive gear mounted on the drive shaft and configured to couple with and drive the driven gear to transmit a driving force to the process cartridge;

an upper cover structured to open and close with respect to the image forming apparatus;

a front cover structured to open and close with respect to the image forming apparatus; and at least one block component configured to block coupling of the drive gear and the driven gear by contacting the driven shaft while interlocked with opening and closing of the upper cover, wherein the process cartridge is detachably attachable to the image forming apparatus from the front top side thereof by opening and closing the upper cover, a portion of the block component which blocks coupling of the drive gear and the driven gear is tapered, and a portion of the block component that contacts the driven gear comprises a shock-absorbing member.

11. An image forming apparatus comprising:

at least one process cartridge including a photosensitive element, a development unit, a toner storage unit, a driven shaft and a driven gear mounted thereon and which is detachably attachable to the image forming apparatus from a top front side thereof;

a drive shaft;

a drive gear mounted on the drive shaft and configured to couple with and drive the driven gear to transmit a driving force to the process cartridge;

an upper cover structured to open and close with respect to the image forming apparatus;

a front cover structured to open and close with respect to the image forming apparatus; and at least one block component configured to block coupling of the drive gear and the driven gear by contacting the driven shaft while interlocked with opening and closing of the upper cover, wherein the process cartridge is detachably attachable to the image forming apparatus from the front top side thereof by opening and closing the upper cover, the block component comprises a biasing member, the biasing member being configured to bias the driven shaft from above when the drive gear meshes with the driven gear, and a side of the biasing member that contacts the driven shaft comprises a shock-absorbing member.

* * * * *